US005644843A

United States Patent [19]

Young

[11] Patent Number: 5,644,843

[45] Date of Patent: Jul. 8, 1997

[54] EASILY LOADED UTILITY KNIFE

[76] Inventor: Monte Young, 7175 Sulphur Well Rd., Nicholasville, Ky. 40356

[21] Appl. No.: 550,342

[22] Filed: Oct. 30, 1995

[51] Int. Cl.[6] ..... B26B 1/08; B26B 1/10

[52] U.S. Cl. ..... 30/124; 30/162; 30/335

[58] Field of Search ..... 30/162, 163, 335, 30/336, 329, 342, 337, 339, 124

[56] References Cited

U.S. PATENT DOCUMENTS

| | | | |
|---|---|---|---|
| D. 259,697 | 6/1981 | Brizzolara, Jr. . | |
| D. 348,819 | 7/1994 | Craig . | |
| 2,107,736 | 2/1938 | Huber | 30/335 X |
| 2,784,489 | 3/1957 | Reise . | |
| 3,316,635 | 5/1967 | Merrow et al. . | |
| 3,593,417 | 7/1971 | West et al. . | |
| 3,708,881 | 1/1973 | Bennett . | |
| 3,943,627 | 3/1976 | Stanley, Jr. . | |
| 4,509,260 | 4/1985 | Gringer . | |
| 4,517,741 | 5/1985 | Castelluzzo . | |
| 4,663,845 | 5/1987 | Weimann . | |
| 4,761,882 | 8/1988 | Silverstein . | |
| 4,953,293 | 9/1990 | Sterlacci . | |
| 5,251,380 | 10/1993 | Craig . | |
| 5,301,428 | 4/1994 | Wilcox . | |
| 5,303,474 | 4/1994 | Keklak et al. . | |
| 5,386,632 | 2/1995 | Schmidt . | |
| 5,404,645 | 4/1995 | Janser . | |
| 5,426,855 | 6/1995 | Keklak et al. . | |

*Primary Examiner*—Douglas D. Watts
*Attorney, Agent, or Firm*—Oliff & Berridge

[57] ABSTRACT

A retractable blade utility knife is provided with storage for spare blades within the knife handle and a knife blade carrier that can be actuated to an operative position in a direction longitudinal to the knife housing, and to a knife blade loading position in a direction transverse to the knife housing, without disassembly of the knife housing. An externally accessible button extends from an L-shaped slot through a housing shell of the knife and allows for actuation of the knife blade carrier from a loading position to an operative position in one continuous motion. The externally accessible button is connected at its proximal end to a flexible arm on the blade carrier. The distal end of the flexible arm of the blade carrier has a transversely extending lip that selectively engages with longitudinally spaced notches on horizontal ribs extending from the inside surface of the knife housing shell.

7 Claims, 5 Drawing Sheets

24a
24
40
44
42
46
45
47
49
32d
30a
27
30g
26a
26
26b
67
66
64
60

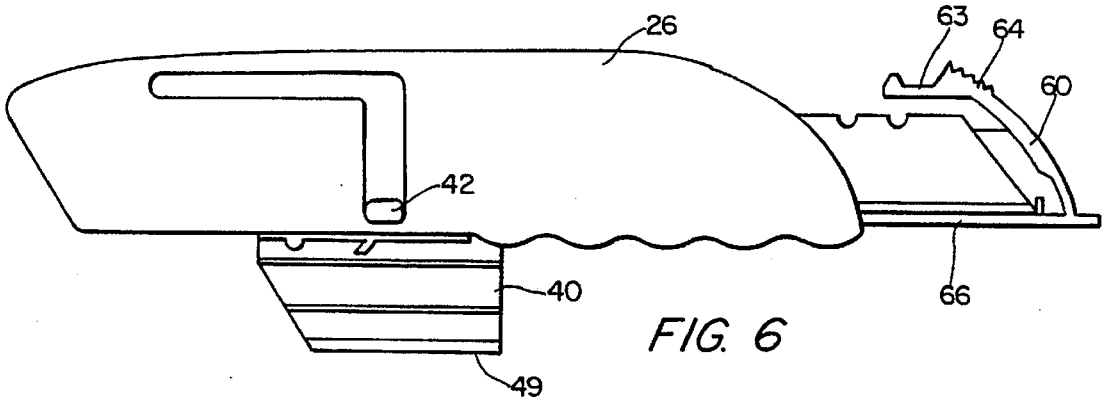
FIG. 6
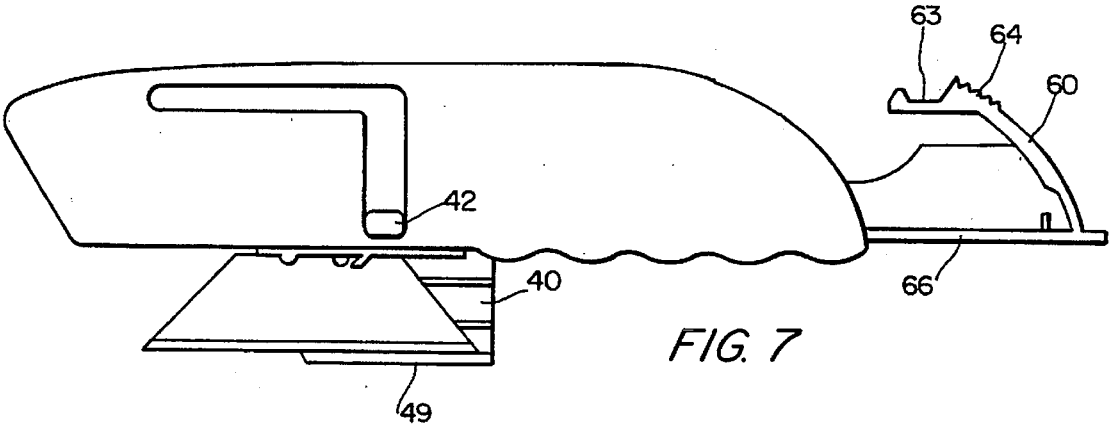
FIG. 7
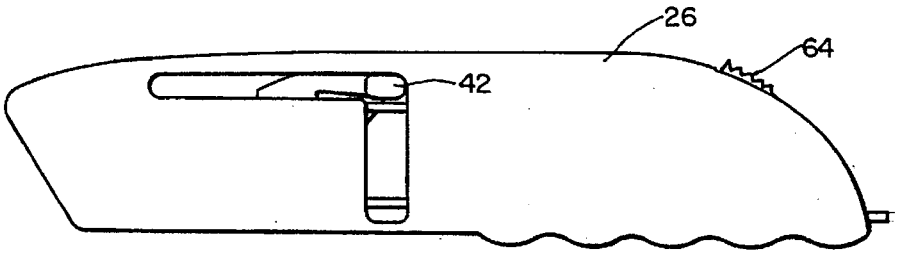
FIG. 8
FIG. 9
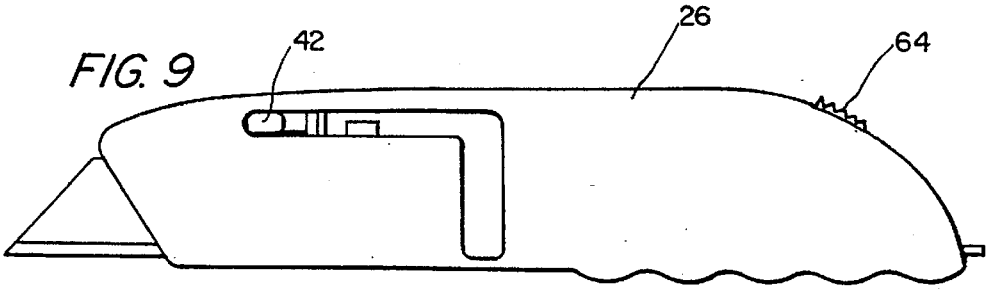

EASILY LOADED UTILITY KNIFE

BACKGROUND OF THE INVENTION

1. Field of the Invention

The present invention relates to a retractable blade utility knife, and more particularly to a retractable blade utility knife that allows for the storage of spare blades within the knife handle and that allows for the replacement of knife blades without disassembly of the knife handle. Furthermore, the present invention relates to a utility knife that includes an ergonomically shaped handle or body, a cutting blade movable in the body to extend a cutting portion of the blade outwardly of the body at one end of the knife body, externally accessible means for moving the cutting blade between the extended cutting position and a retracted position of withdrawal into the handle, the same externally accessible means for moving the cutting blade also allowing for movement of the cutting blade to a position wherein the blade can be replaced with a spare blade, and provision for storage of several spare blades within the knife handle.

2. Related Art

The field of utility knives includes many examples of previous attempts to provide a utility knife that satisfies one or more of the many concerns for such knives. Related knives include knives that have handles providing a forward longitudinal cavity in which a blade carrier member is slidably received, and a rear cavity in which a number of spare blades are received. In existing knives, the blade carrier member carries a double-ended cutting blade, and is movable longitudinally of the forward cavity between a retracted safety position with the blade entirely within the handle, and an extended cutting position in which a triangular end part of the blade extends forwardly out of the handle. The handle is vertically split and includes two portions which are almost mirror images of one another. A screw secures the handle portions together and allows their separation with the use of a screwdriver for substituting one of the spare blades for a used cutting blade.

Existing utility knives also include knives in which blades may be changed without disassembly of the handles by forward extension therefrom of a forward part of a channel-like blade carrier member. Existing knives also include knives in which the handle halves are connected by a pivot positioned intermediate along the length of the handle, and are movable about the pivot between open and closed positions. In such knives, a blade carrier is mounted between the handle halves and the blade carrier is adapted for reciprocal movement toward and away from the blade receiving opening.

A typical shortcoming of existing retractable blade utility knives is the lack of a knife that includes both a means for replacing used blades with new blades without disassembly of the handles, and providing a means for storage of spare blades within the knife handles.

Another shortcoming of existing retractable blade utility knives is the lack of a knife that includes means for actuating the knife blade carrier to a position for loading of a new knife blade and then, in one continuous motion, actuating the knife blade carrier to a position wherein the knife blade is extended from the knife handle for use, all without requiring any disassembly of the knife.

SUMMARY OF THE INVENTION

The present invention provides a utility knife with an ergonomically-shaped handle portion that is split along a vertical longitudinal parting plane to form two handle shells. Each shell has an exterior substantially convex surface and an interior substantially concave surface. A forward longitudinal cavity is defined between the front concave surfaces of each shell and is separated from a rear longitudinal cavity by a vertical rib that is integral with and extends perpendicularly from at least one of the internal concave surfaces of the shells. A blade carrier is mounted between the handle shells within the forward longitudinal cavity. The blade carrier is adapted for reciprocal movement within the forward longitudinal cavity in both a longitudinal direction toward and away from the front end of the knife, and in a transverse direction between the rearward-most, fully retracted position of the blade carrier and a position extending below the handle shells in which the old used knife blade can be replaced with a new blade. The blade carrier includes an integral, cantilevered, flexible arm from which a button extends transversely, passing through an L-shaped opening through one of the handle shells. The flexible arm of the blade carrier includes at one end a transversely extending tab that engages with one of a series of recesses or notches formed in the distal edge of at least one horizontal rib defining the longitudinal leg of the L-shaped opening through the handle shell.

The blade carrier also includes a plurality of horizontal ribs extending transversely from the body of the blade carrier and providing means for guiding the blade carrier along mating horizontal ribs that extend from the internal concave surface of the handle shells.

The rearward longitudinal cavity between the handle shells is also provided with longitudinal horizontal ribs extending from the concave surface of the shells that act as guiding surfaces for a spare blade holder. The spare blade holder reciprocates from a forward-most, fully retracted position to a rearward-most, fully extended position in which spare blades can loaded or retrieved from the spare blade holder.

The present invention provides a utility knife that offers both comfort and convenience in use. The ergonomic design of the handle portion provides a good grasp on the knife with plenty of surface area so that cutting forces do not cause discomfort from concentrated forces on a small area of the user's hand. Spare blades are conveniently stored in the rear longitudinal cavity of the knife handle and are easily accessed without the need for a tool or any disassembly of the knife. When a blade change is needed, the blade carrier is easily extended from the front longitudinal cavity to a position extending downwardly below the bottom of the knife handle, with such a position allowing for the easy removal and replacement of a used blade. After replacement of a used blade with a new blade, the blade carrier is easily moved in one continuous motion upwardly back into the forward longitudinal cavity of the knife handle and then forwardly to various amounts of extension of the knife blade prior to its use. The transversely extending button and flex arm of the blade carrier along with the longitudinally spaced notches in the distal edge of at least one horizontal rib allow the knife blade to be extended to varying degrees and locked into position, all with the use of one hand.

These and other advantages of the present invention will be apparent from a reading of the following detailed description of a preferred embodiment of the invention, taken in conjunction with the following drawing figures.

BRIEF DESCRIPTION OF THE DRAWINGS

The invention is better understood by reading the following Detailed Description of the Preferred Embodiment with reference to the accompanying drawing figures, in which like reference numerals refer to like elements throughout, and in which:

FIG. 6 is a side elevation view of the utility knife of the present invention showing the spare blade holder moved to a fully extended position with a spare blade held by the spare blade holder and the blade carrier moved to its lower-most position and ready to receive a new knife blade;

FIG. 7 is a side elevation view of the utility knife of the present invention showing a knife blade having been removed from the spare blade holder and installed on the blade carrier;

FIG. 8 is a side elevation view of the utility knife of the present invention showing the integral actuation button of the blade carrier in the position it assumes when the blade carrier has been moved to its uppermost fully retracted position;

FIG. 9 shows a side elevation view of the utility knife of the present invention showing the position of the integral actuation button of the blade carrier and the position of a knife blade once the blade carrier has been moved to its fully extended and operational position;

DETAILED DESCRIPTION OF THE PREFERRED EMBODIMENTS

Figure 1:
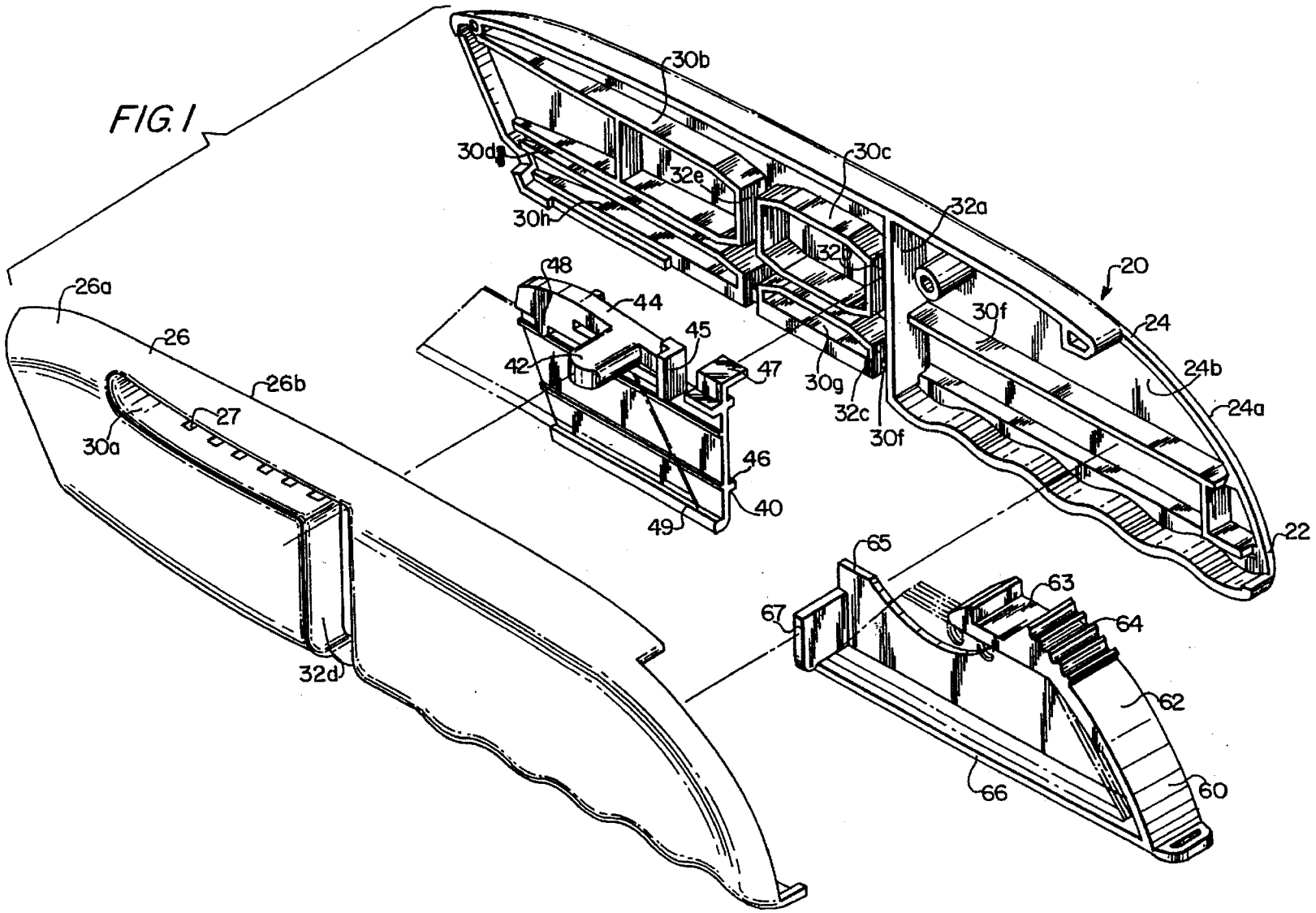
FIG. 1 is an exploded perspective view of the utility knife of the present invention, with a spare blade holder and a blade carrier shown in between two knife housing shells.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Initially referring to FIG. 1, a utility knife is generally designated by the numeral 20. Knife 20 includes a handle 22 that is elongated and is split along a substantially vertical, longitudinal parting plane into two knife housing shells 24 and 26. Knife housing shells 24 and 26, respectively, each have a substantially convex outer surface 24*a* and 26*a*, respectively, and a substantially concave inner surface 24*b* and 26*b*, respectively. Knife housing shells 24 and 26 can be manufactured from die-cast aluminum, injection molded plastics, or other known materials. The knife housing shells can be joined together to form an assembled knife by using screws or other mechanical fasteners, or by various forms of bonding or welding.

Longitudinal horizontal ribs 30*a*, 30*b*, 30*c*, 30*d*, 30*e*, 30*f*, and 30*g* and vertical ribs 32*a*, 32*b*, 32*c*, 32*d*, and 32*e* extend at substantially right angles to the inner concave surfaces 24*b* and 26*b* of housing shells 24 and 26. The horizontal ribs and the vertical ribs provide reinforcement to the knife housing shells 24 and 26 and provide guiding surfaces for controlling the reciprocal movement of blade carrier 40 and spare blade holder 60.

Figure 3:
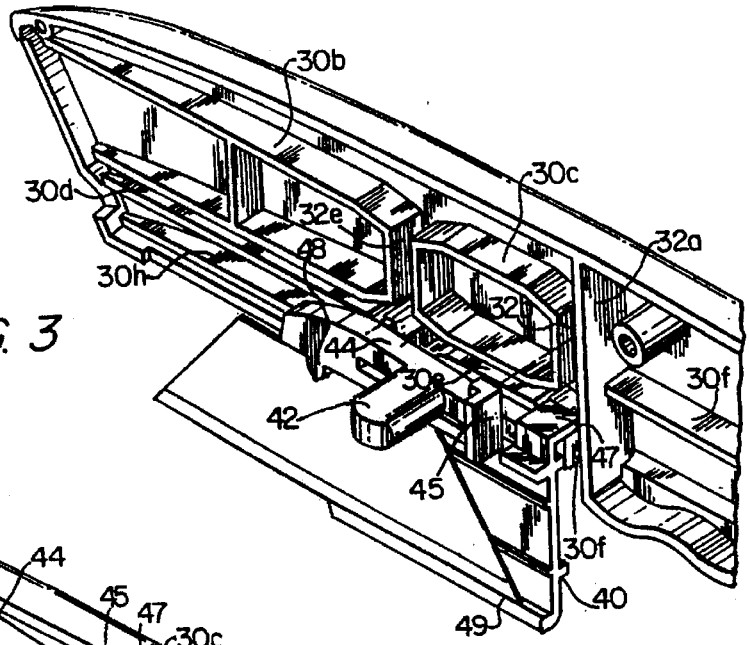
FIG. 3 is a perspective view of one of the knife housing shells showing the blade carrier in its lower-most position following installation of a new blade and in position for movement in the direction of the arrow to a position from which the blade can be extended from the housing.

As shown in FIG. 1, knife housing shell 26 is provided with an L-shaped slot therethrough which allows for the passage of a laterally-extending button 42 that is integral with a flex arm 44 of blade carrier 40. Movement of button 42 along the vertical leg of the L-shaped slot in knife housing shell 26 causes reciprocation of blade carrier 40 from its fully retracted position within knife housing 22 to its lowermost extended and non-operative position wherein a new blade can be placed in blade carrier 40, as shown in FIGS. 3, 6 and 7. Movement of button 42 along the horizontal leg of the L-shaped slot in knife housing shell 26, as shown in FIGS. 8, 9, 10 and 11, reciprocates blade carrier 40 between a fully retracted position within knife housing 22 and varying degrees of extension to operative positions from knife housing 22.

Figure 2:
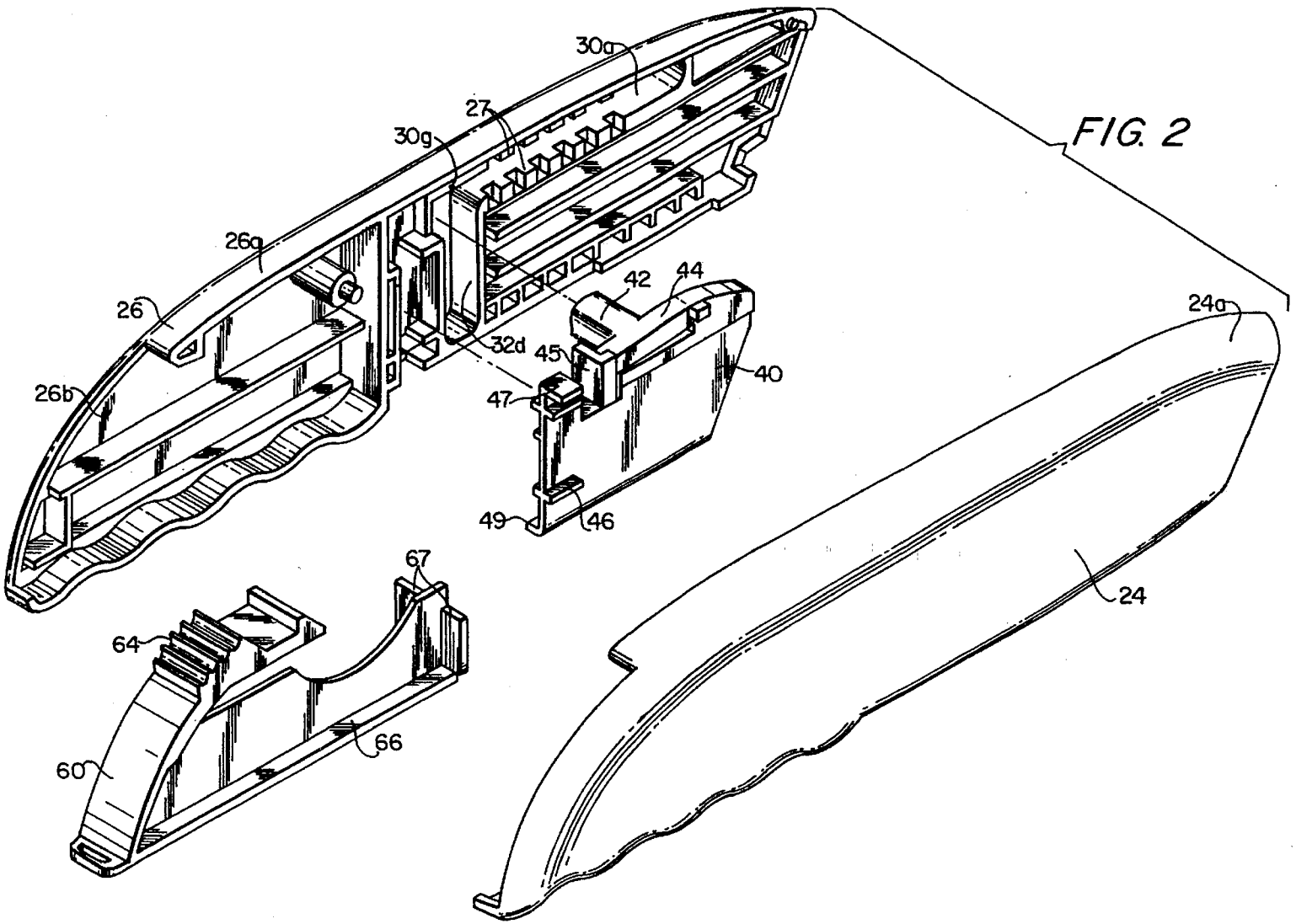
FIG. 2 is an exploded perspective view of the utility knife of the present invention similar to FIG. 1 and taken in substantially the opposite direction from the view of FIG. 1.
Figure 12:
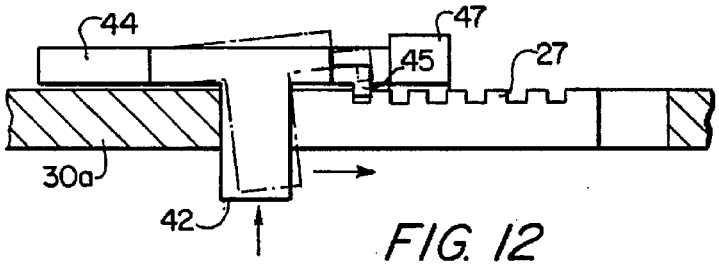
FIG. 12 is a fragmentary view taken in the direction of arrows 12—12 in FIG. 10.
Figure 13:
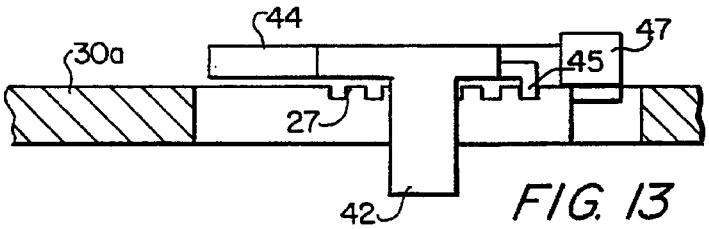
FIG. 13 is a fragmentary view taken in the direction of arrows 13—13 in FIG. 11.

As shown in FIGS. 2, 12 and 13, a series of longitudinally spaced recesses or notches 27 extend inwardly from the distal edge of a horizontal rib 30*a* that defines the bottom edge of the horizontal portion of the L-shaped slot through knife housing shell 26, and inwardly from the distal edge of another horizontal rib 30*g* that is vertically spaced from rib 30*a* and that defines the top edge of the horizontal portion of the L-shaped slot. Longitudinally spaced notches 27 are positioned to receive a lip 45 on flexible arm 44 of blade carrier 40 as blade carrier 40 is reciprocated along guiding ribs 30*c* and 30*b*, parallel to ribs 30*a* and 30*g* to varying degrees of extension to operative positions from knife housing 22, as shown in FIGS. 12 and 13. The notches 27 and blade carrier lip 45 serve to lock blade carrier 40 at varying degrees of extension to operative positions.

Spare blade holder 60, best seen in FIGS. 1 and 2, reciprocates within the rear longitudinal cavity defined between knife housing shells 24 and 26. Spare blade holder 60 is provided with an outwardly convex rim 62 having a notch 63 and serrations 64 that provide for easy gripping of the spare blade holder 60. Spare knife blades are supported on spare blade holder 60 between a wall 65, a bottom flange 66 and a front flange 67. Spare blade holder 60 reciprocates along longitudinal, horizontal guide rib 30*f* from a fully retracted position within knife blade housing 22 to a fully extended position, at which spare blades can be removed from or added to spare blade holder 60. When spare blade holder 60 is actuated all the way into its fully retracted position within knife housing 22, the outer surface of convex rim 62 is flush with the outer substantially convex surfaces 26*a* and 24*a* of the knife housing shells.

Blade carrier 40, best seen in FIGS. 1 and 2, reciprocates within the forward longitudinal cavity of knife housing 22 and is provided with abbreviated, horizontal, longitudinally extending ribs 46 and 47 that serve to guide and support blade carrier 40 as it is reciprocated in order to extend and retract a knife blade to or from operative positions from knife housing 22. When blade carrier 40 is fully retracted into knife housing 22, ribs 46 and 47 are received within a vertical groove defined between vertical ribs 32*b*, 32*c* and 32*a* of knife housing 22. When in this fully retracted, longitudinal position, blade carrier 40 can be reciprocated in a vertical direction along the groove defined between vertical ribs 32*b*, 32*c* and 32*a*. When blade carrier 40 is moved to its fully lowered position, as shown in FIGS. 3, 6 and 7, at which a knife blade supported in blade carrier 40 can be replaced, rib 47 of blade carrier 40 engages with a lower horizontal rib 30*f* of knife housing shell 24, with rib 30*f* acting as a stop to prevent blade carrier 40 from being lowered out of engagement with the groove defined between vertical ribs 32*b*, 32*c*, and 32*a*.

The upper edge of blade carrier 40 is interrupted by an integral cantilevered flexible arm 44 that is partially bordered by a vertical slot extending in from the upper edge of blade carrier 40 and intersecting with a longitudinal slot parallel to the upper edge of blade carrier 40. As best seen in FIG. 1, the cantilevered end of flexible arm 44 terminates in a tab or lip 45 that extends perpendicular to the plane of blade carrier 40. An integral button 42 extends substantially perpendicular to an intermediate portion of cantilever arm 44. Button 42 extends through the L-shaped slot formed in knife housing shell 26 and is accessible to provide controlled movement of blade carrier 40 when knife housing shells 24 and 26 are assembled together.

As illustrated in FIGS. 10–13, when pressure is applied to button 42 in order to extend the knife blade to varying degrees, flex arm 44 bends at its proximal end, thus causing lip 45, located at its distal end, to be moved out of the plane of blade carrier 40. This movement of flexible arm 44 causes lip 45 to be removed from one of the longitudinally spaced notches 27 formed in the horizontal ribs 30*a* and 30*g* of knife housing shell 26.

Button 42, and hence blade carrier 40, are moved to a position providing the desired amount of knife blade extension by applying axial pressure to button 42 and then pressure in the desired direction of extension or retraction from knife housing 22. Release of the axial pressure on button 42 allows tab 45 to re-engage with a pair of vertically aligned notches 27. Movement of blade carrier 40 to its fully retracted position, with abbreviated longitudinal ribs 46 and 47 contained within the vertical groove defined between vertical ribs 32*b*, 32*c*, and 32*a*, places button 42 in alignment with the vertical leg of the L-shaped slot formed through knife housing shell 26. Subsequently, button 42, and hence blade carrier 40, can be moved vertically along the vertical leg of the L-shaped slot from the fully retracted position of blade carrier 40, to a lowermost extended position wherein blade carrier 40 can be accessed for replacement of a knife blade.

Figure 4:
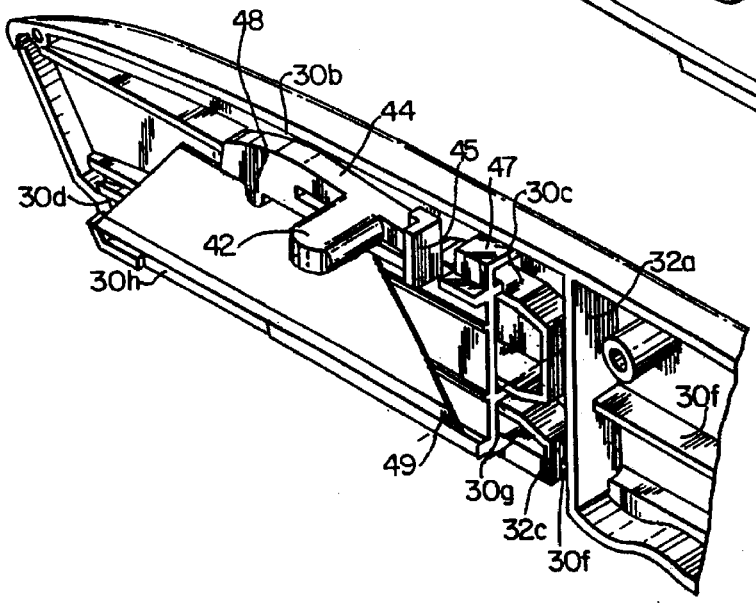
FIG. 4 is a perspective view of a knife housing shell similar to that shown in FIG. 3 with the blade carrier supported on the longitudinal horizontal ribs of the knife housing shell and in position for extension from the shell.
Figure 5:
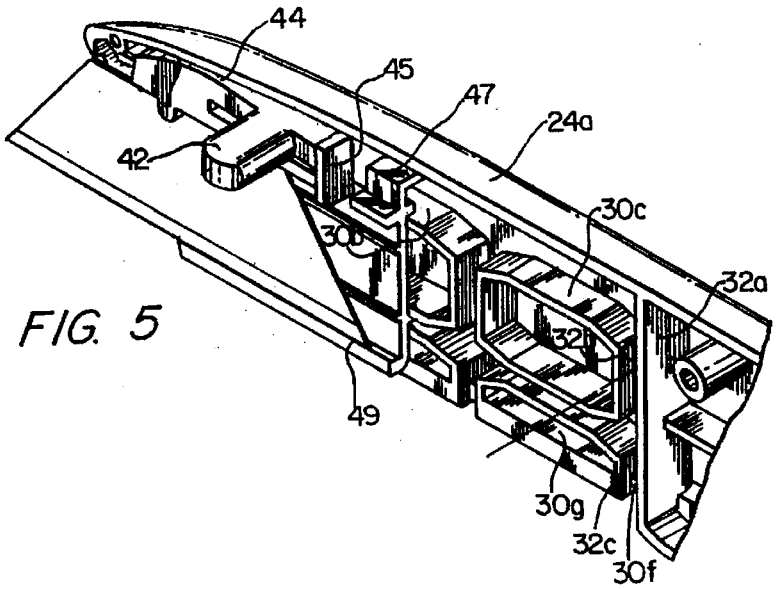
FIG. 5 is a perspective view of a knife housing shell similar to that of FIGS. 3 and 4 showing the blade carrier moved longitudinally in the direction of the arrow in FIG. 4 along the horizontal ribs to a position where the knife blade extends from the housing.
Figure 10:
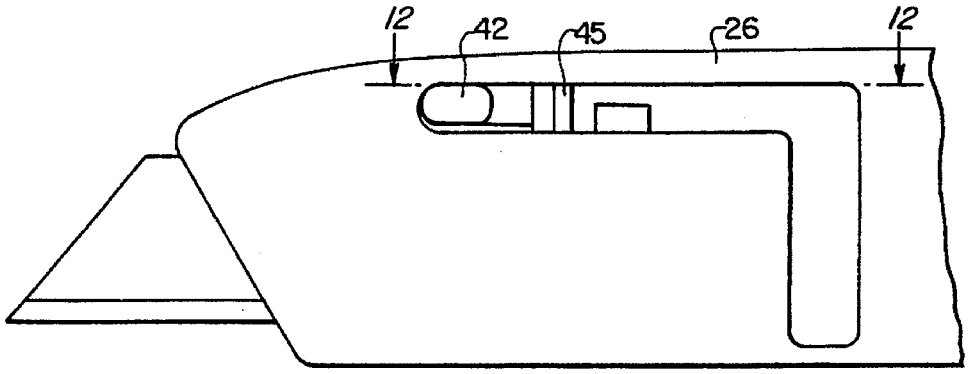
FIG. 10 is a side elevation view similar to that of FIG. 9 showing the front end portion of the knife with the position of the integral actuation button and locking tab of the blade carrier when the knife blade is in its fully extended and operational position.
Figure 11:
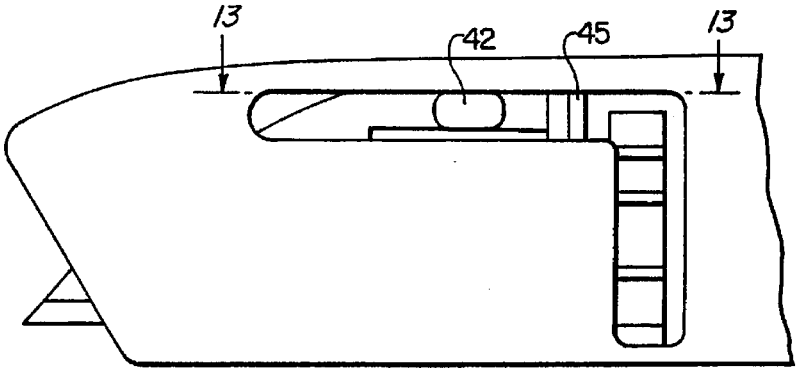
FIG. 11 is a side elevation view similar to that of FIG. 9 showing the position of the integral actuation button and locking tab of the blade carrier when the knife blade is partially retracted into the knife housing.

The process of extending blade carrier 40 to its fully lowered position, extending spare blade holder 60 to its fully extended position in order to provide access to a spare blade, loading a spare blade into blade carrier 40, and moving blade carrier 40 back up into knife housing 22 and continuously extending it to a desired degree of extension, is illustrated sequentially in FIGS. 6–9. The position of blade carrier 40 relative to knife housing shell 24 as blade carrier 40 is moved from its fully lowered loading position upwardly into the front longitudinal cavity of knife housing 22, and then continuously to a fully extended position, is shown sequentially in FIGS. 3–5. Knife blades loaded into the blade carrier 40 when blade carrier 40 is moved to its fully lowered position, as shown in FIG. 3, are supported on blade carrier 40 by a lower horizontal flange 49 and by a locking tab 48 that extends into a vertical notch provided in the upper edge of a spare knife blade.

Modifications and variations of the above-described embodiments of the present invention are possible, as appreciated by those skilled in the art in light of the above teachings.

It is therefore to be understood that, within the scope of the appended claims and their equivalents, the invention may be practiced otherwise than as specifically described.

What is claimed is:

1. A utility knife comprising:

a handle having a front end and a back end, with the front end having an opening therethrough for passage of a knife blade during use of the utility knife to perform a cutting operation;

said handle being separated generally along a vertical parting plane extending longitudinally along the handle to form a pair of mating housing shells with a central cavity defined therebetween;

each of said housing shells having an outer substantially convex surface and an inner substantially concave surface;

a plurality of horizontal and vertical housing ribs extending longitudinally and transversely to said handle, respectively, and at approximately right angles from said inner substantially concave surfaces;

at least one of said vertical housing ribs separating said central cavity into a forward longitudinal cavity and a rearward longitudinal cavity;

a blade carrier member being received within said forward longitudinal cavity and having a plurality of longitudinal blade carrier ribs that slidably engage with a plurality of said horizontal housing ribs for supporting and guiding said blade carrier member during longitudinal movement of said blade carrier member to extend and retract a knife blade through said front end opening;

at least one of said blade carrier ribs being received within a substantially vertical groove defined between two of said vertical housing ribs for guiding said blade carrier member during movement of said blade carrier member in a direction substantially perpendicular to said longitudinal movement to a position extending below a bottom side of said handle, in which position a knife blade carried by said blade carrier member can be replaced.

2. The utility knife of claim 1, further including:

a spare blade holder being received within said rearward longitudinal cavity, said spare blade holder being slidably supported by at least one of said horizontal housing ribs for movement between a fully retracted position within said handle and a fully extended position wherein said spare blade holder extends rearwardly from said handle back end for loading and retrieval of spare blades.

3. The utility knife of claim 1 wherein:

said blade carrier member has an integral cantilevered, flexible arm depending from an upper edge of said blade carrier member;

said flexible arm having a transversely extending lip at a distal end of said flexible arm and a button that extends transversely from an intermediate position on said flexible arm; and one of said horizontal housing ribs having a plurality of notches spaced along a distal edge of said horizontal housing rib for selectively receiving said transversely extending lip.

4. The utility knife of claim 3 wherein:

one of said housing shells has an L-shaped slot therethrough, said button extending through said L-shaped slot for accessibility from outside the mating housing shells, wherein axial pressure applied to said button causes said flexible arm to bend, thereby removing said transversely extending lip from one of said notches.

5. A utility knife comprising:

a handle having a front end, a back end, a top side and a bottom side, and a longitudinal cavity being defined within said handle;

a blade carrier being received within said longitudinal cavity and having means for supporting a knife blade;

means for supporting and guiding said blade carrier during longitudinal movement of said blade carrier towards and away from said handle front end;

means for supporting and guiding said blade carrier during transverse movement of said blade carrier substantially perpendicular to said longitudinal movement, towards and away from a position extending below said handle bottom side, thereby providing access to said means for supporting a knife blade; and a spare blade holder being received within said longitudinal cavity, and means for slidably supporting said spare blade holder during movement of said spare blade holder between a fully retracted position within said handle and a fully extended position at which said spare blade holder extends rearwardly from said handle back end for loading and retrieval of spare blades.

6. A method of operating a utility knife comprising the steps of:

providing a knife handle having a longitudinal cavity defined therein, an L-shaped slot passing through an outer shell of said knife handle into said longitudinal cavity, and a knife blade carrier mounted within said cavity for reciprocal movement along a path substantially parallel to said L-shaped slot with said knife blade carrier having actuation means extending through said L-shaped slot;

applying axial pressure to said actuation means;

moving said actuation means and said knife blade carrier along a first leg of said L-shaped slot in a direction parallel to the longitudinal extent of the knife handle;

moving said actuation means and said knife blade carrier along a second leg of said L-shaped slot perpendicular to said first leg to a position at which said actuation means abuts an end of said second leg and said knife blade carrier extends from said longitudinal cavity to below said knife handle;

placing a knife blade in said knife blade carrier;

moving said actuation means and said knife blade carrier along said second leg of said L-shaped slot to retract said knife blade carrier into said longitudinal cavity; and moving said actuation means and said knife blade carrier along said first leg of said L-shaped slot to extend said knife blade from said knife handle to a position ready for use.

7. The method of claim 6, further including:

providing a spare blade holder within said longitudinal cavity mounted for reciprocal movement in a direction parallel to the longitudinal extent of the knife handle;

moving said spare blade holder to a position at which said spare blade holder extends from said longitudinal cavity; and retrieving a spare blade from said spare blade holder for placement in said knife blade carrier.

* * * * *